US005572942A

United States Patent [19]

Lage

[11] Patent Number: 5,572,942

[45] Date of Patent: Nov. 12, 1996

[54] FORESAIL

[76] Inventor: Axel Lage, Elbchaussee 266, 22606 Hamburg, Germany

[21] Appl. No.: 399,619

[22] Filed: Mar. 7, 1995

[30] Foreign Application Priority Data

Mar. 21, 1994 [DE] Germany ..... 9404724 U

[51] Int. Cl.[6] ..... B63H 9/04

[52] U.S. Cl. ..... 114/106

[58] Field of Search ..... 114/102, 103, 114/104, 105, 106, 108

[56] References Cited

U.S. PATENT DOCUMENTS 3,147,729 9/1964 Barnard ..... 114/108
3,341,907 9/1967 Michael ..... 114/108
4,690,088 9/1987 Perini ..... 114/108
4,733,624 3/1988 Belvedere ..... 114/103
5,014,637 5/1991 Stevenson, IV ..... 114/106

*Primary Examiner*—Stephen Avila
*Attorney, Agent, or Firm*—Nixon & Vanderhye

[57] ABSTRACT

A sailboat with roller furling has a first foresail rolled about a forestay by suitable rotatable gearing. A second foresail includes a flap secured along one side of the second foresail adjacent its luff and which flap extends about the furled first foresail for releasable securement to a strip sewn along the opposite side of the second foresail. In this manner, a second foresail can be deployed while the first foresail remains roller furled.

4 Claims, 1 Drawing Sheet

FORESAIL

The invention relates to a foresail for yachts or dinghies, having a luff, a foot and a leech which connects the foot to the luff.

It is known to use a so-called roller jib on dinghies and yachts with which the foresail, which is usually called a jib, can be quickly furled around the forestay when the jib is not required or is not to be used for other reasons. Whilst a roller system does have the advantage that the current foresail does not always have to be specially unhanked from the forestay and be rigged afresh when it is next used, it also has the disadvantage that when the jib is furled, no other sail can be rigged on the forestay. There has therefore already been a change, to providing, alongside the stay for a roller furling gear known per se, a second forestay for rigging another sail. This is however extremely expensive and cannot be fitted to most dinghies and yachts.

It is the object of the invention to provide a sail which can also be hoisted when the current foresail is furled on the roller gear and when there is no second forestay present.

This object is achieved with a foresail of the type mentioned at the beginning which is characterised in that a flap is sewn onto one side of the foresail in the region of the luff and essentially parallel thereto; in that a strip provided with eyes is sewn onto the other side of the foresail; and in that the leading edge of the flap has securing means, by which the flap can be secured to the strip.

It is thus possible to rig the foresail according to the invention over the furled roller jib.

The flap of the foresail according to the invention is either sewn in straight away when a new sail is manufactured or is additionally sewn onto foresails which have already been used. If the foresail according to the invention is a sail for light wind or strong wind, the length of the current sail is rigged permanently on the roller gear. If a sail for light wind or strong wind is now to be rigged as a foresail, the current foresail is furled with the roller gear and the foresail according to the invention is fastened with its flap around the roller jib and clipped by the securing means provided such as stay sliders, snap hooks or similar onto the strip sewn onto the other side of the foresail. Eyes are also provided on the strip for this purpose.

It is clear to the specialist how the securing means can be arranged. If eyes are provided on both the leading edge of the flap and on the strip, the connection can be made using hooks or using a lashing.

The invention is described in more detail below with reference to a drawing.

Figure 1:
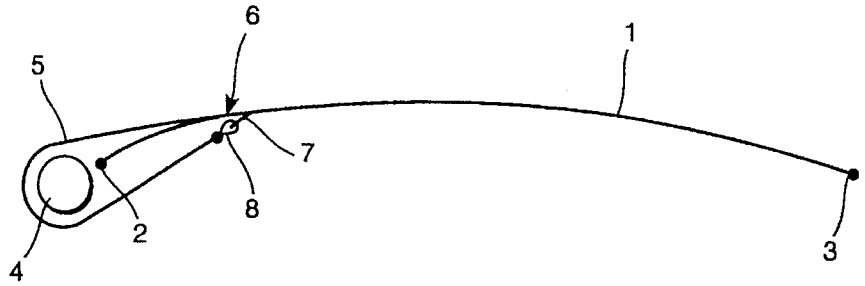
FIG. 1 is a schematic plan view of a foresail according to the present invention.

Shown schematically in the drawing is a foresail 1 in horizontal section which in a manner known per se has a luff 2, a foot 2*a*, and a leech 3 which connects the foot to the luff 2. The foresail is usually approximately triangular in shape.

Shown schematically in the vicinity of the luff 2 is a roller jib 4, i.e. a furlable foresail 4*a* which is furled around a rotatable forestay 4*b* of a so-called roller gear.

Figure 2:
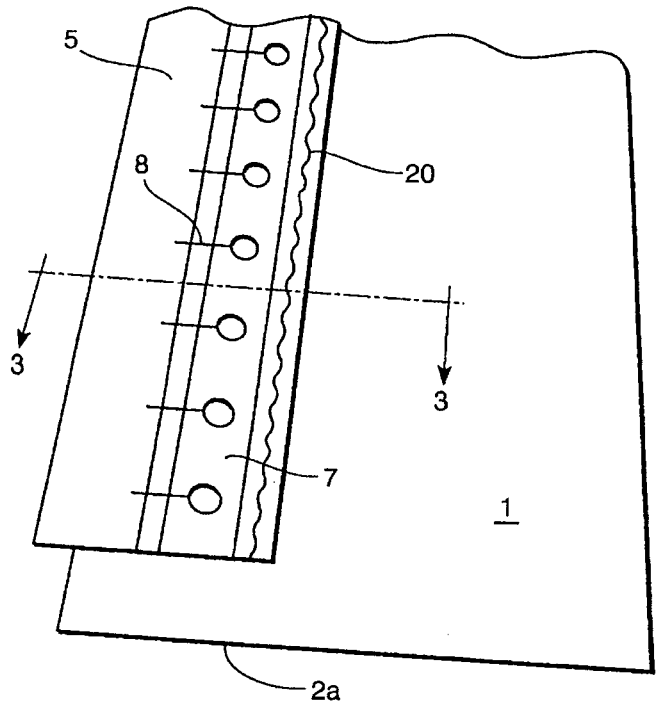
FIG. 2 is a fragmentary side elevational view illustrating the foresail hereof.
Figure 3:
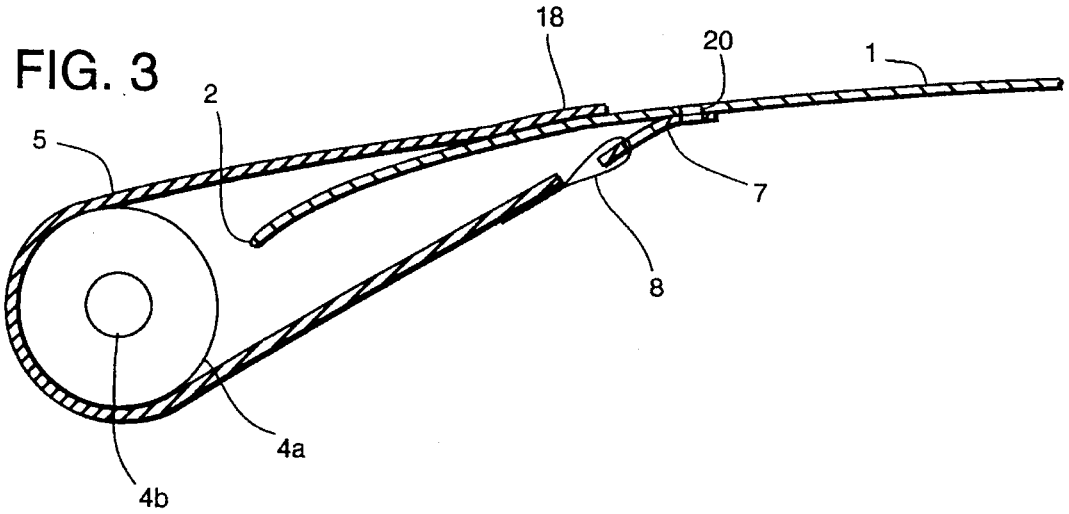
FIG. 3 is an enlarged cross-sectional view taken generally about on line 2—2 of FIG. 2 illustrating the manner of connection of the flap and strip about another roller furled foresail.

At a distance from the luff 2 a flap 5 is sewn on at 18 (FIG. 2) at position 6 to one side of the foresail 1, parallel to the luff 2 and roughly over the full length of the foresail 1. The flap 5 is dimensioned such that it can be fastened around the roller jib 4 and secured to the other side of the foresail 1, in the approximate vicinity of region 6 where the luff of the flap 5 can be secured with securing means 8 to a strip 7 which is sewn onto the other side of the foresail 1 as indicated at 20 in FIG. 2. The strip 7 also runs approximately parallel to the luff 2 and roughly over the full height of the sail. Eyes, which are not shown, are provided at intervals in the additionally sewn-on strip 7 into which the securing means 8, for example snap hooks, stay sliders etc., can be clipped.

I claim:

1. Sail apparatus comprising:

a first foresail, a rotatable forestay for roller furling said first foresail about said forestay, a second foresail having a luff, a flap extending along said second foresail adjacent said luff and secured to and along one side of said second foresail, said flap having a leading edge, and a plurality of first elements extending along the opposite side of said second foresail and engaging with cooperable second elements along the leading edge of said flap for securing said flap to said opposite side of said second foresail with said flap extending about and substantially encompassing said roller furled first foresail.

2. Sail apparatus according to claim 1 wherein said flap extends substantially coextensively with and generally parallel to said luff, and a strip extending along said opposite side of said second foresail and carrying said first elements.

3. Sail apparatus according to claim 2 wherein said first and second elements are releasably secured relative to one another.

4. Sail apparatus according to claim 2 wherein said flap and said strip are sewn to said second foresail along said one side thereof.

* * * * *